US008099805B1

(12) United States Patent
Webb

(10) Patent No.: US 8,099,805 B1
(45) Date of Patent: Jan. 24, 2012

(54) SINK AND INSTALLATION

(76) Inventor: Paul K. Webb, Soddy Daisy, TN (US)

( * ) Notice: Subject to any disclaimer, the term of this patent is extended or adjusted under 35 U.S.C. 154(b) by 1213 days.

(21) Appl. No.: 11/657,333

(22) Filed: Jan. 24, 2007

(51) Int. Cl.
*A47K 1/09* (2006.01)

(52) U.S. Cl. ..... 4/619

(58) Field of Classification Search ..... 4/632; D23/290
See application file for complete search history.

(56) References Cited

U.S. PATENT DOCUMENTS 2,157,786 A * 5/1939 Coordes ..... 4/632
2,532,769 A * 12/1950 Houpt ..... 4/632
D192,493 S * 4/1962 Lyon ..... D23/290
4,374,695 A * 2/1983 Ikeda et al. ..... 4/632 X
* cited by examiner

*Primary Examiner* — Lori Baker
(74) *Attorney, Agent, or Firm* — Stephen J. Stark; Miller & Martin PLLC

(57) ABSTRACT

A sink and its installation are shown and described. A lip of the sink defines a continuous outer perimeter which is preferably received within a first inner perimeter of a portion of a countertop so that an upper surface of the countertop extends at or at an elevation above the upper surface of the lip. Preferably a slope leads from the upper surface of the countertop to an upper surface of the lip wherein water or food may be directed from the countertop into the sink. The sink preferably rests on a ledge of the countertop which has been machined or otherwise formed into the countertop. Furthermore, the outer perimeter of the lip of the sink preferably has no discontinuous points thereon wherein when a derivative is taken of an equation defining the outer perimeter, a solution is provided for all points.

16 Claims, 3 Drawing Sheets

SINK AND INSTALLATION

FIELD OF THE INVENTION

The present invention relates to a sink and its installation in various countertop surfaces including stone, solid surface, quartz, and other materials such as are commonly utilized as kitchen countertops and bathroom countertops to provide kitchen sinks, bathroom sinks, etc.

DESCRIPTION OF RELATED ART

Sinks are normally connected to kitchen countertops with clips held underneath the sink such as is shown in U.S. Pat. Nos. 6,785,918 and 6,793,190 and others. These designs often require the installer to lift the sink up from the bottom (an undermount sink) and then attach the clips from the bottom of the countertop which necessarily requires the installer to get below the sink to make the installation. Many times this may be difficult for the installer.

Prior art undermount sinks are normally provided with a lip which has edges which meet at distinct points at the corners such as Model No. EGUH3120 provided by the Elkay Corporation. Other manufacturers have similar constructions.

Above countertop installations provide a sink with a lip which has an upper and lower surface. The lower surface of such an installation rests on an upper surface of the countertop and the upper surface of the lip extends a distance above the upper surface of the countertop so that if one would try to push water across the countertop into the sink, it would contact the lip at least for the thickness of the lip instead of dropping from the upper surface countertop down into the sink or going straight across into the sink. These lips are also believed by the applicant to provide a ridge interiorly to the outer perimeter of the lip which is believed to assist in keeping water in the sink. This ridge has a higher elevation than the outer perimeter of the lip.

There is a perceived need for a sink design in which the countertop surface is at least one of the topmost surfaces relative to a lip of a sink when installed.

Additionally, there is a perceived need for a sink design which can be installed from the top which need not necessarily rely on clips to retain the sink in a desired location.

SUMMARY OF THE INVENTION

Accordingly, it is an object of the present invention to provide a sink which may be installed from above while providing advantages of an undermount sink.

It is another object of the present invention to provide a short lipped sink for use in above-surface installations.

It is another object of the present invention to provide a sink having an upper and outer lip with a continuous perimeter having no discontinuities at any point along that outer surface.

It is another object of the present invention to provide a sink set a predetermined elevation below a top surface of a countertop with the sink having a lip which rests on a ledge which is located below the top planar surface of the counter top.

Accordingly, a new sink provides a relatively narrow lip which is preferably received in a cutout of a countertop so that an upper surface of the sink is located at or below an upper surface of the countertop which is believed to assist in cleaning off the countertop. Furthermore a beveled or rounded edge may lead down from the upper surface of the countertop down to the upper surface of the lip of the sink. The lip of the sink preferably rests on top of a ledge which has been preferably cut, or otherwise formed or provided for the countertop so that the sink may be installed from above and sealed thereto so that the ledge supports the weight of the sink including all the weight of the sink filled with liquid and/or other matter. The ledge is preferably provided with a bevel and/or rounded edge so that it assists in seating and sealing with sink wells. Furthermore, the lip of the sink is preferably manufactured in such a way that it provides a continuous outer perimeter wherein vectors traversing the outer perimeter do not encounter any discontinuities at any point locations.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
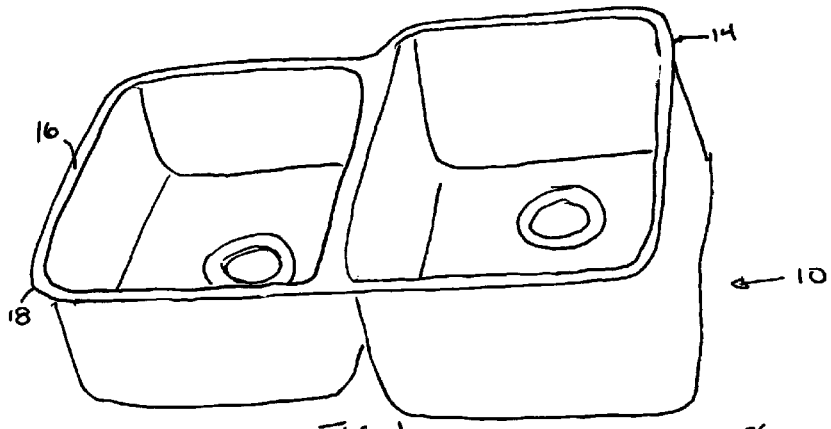
FIG. 1 is a top perspective view of a first presently preferred embodiment of the present invention.

FIG. 1 shows a sink 10 of the presently preferred embodiment of the present invention. The sink 10 may or may not have similar features as prior art sink 12 illustrated in FIG. 9 but preferably has at least one distinguishing feature thereto.

The sink 10 of FIG. 1 has a lip 14 which traverses about an upper elevation 16 and defines a perimeter 18 about the lip 14. While the prior art undermount sink 12 of FIG. 9 has a lip 20 with a perimeter 22, there are distinguishing features between the respective lips 18 and 20.

The lip 18 of the presently preferred embodiment of the sink 10 is continuous in that if a vector where to be placed along any portion of the perimeter 18, then each successive vector would provide a continuous transition from point to point along either straight edge and/or curved portions of the perimeter 18 with no discontinuities.

Figure 9:
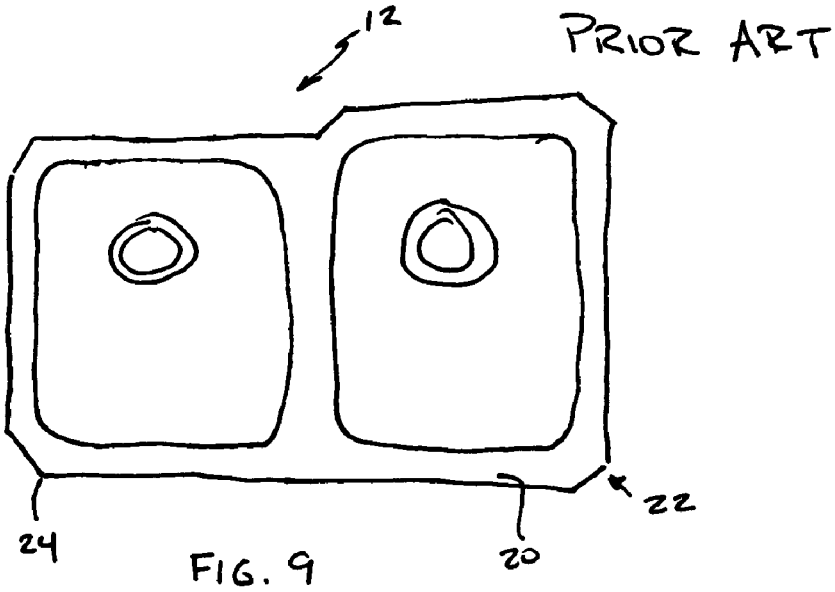
FIG. 9 shows a prior art undermount sink.

Another way of thinking of this is when examining the prior art design of FIG. 9, if an equation corresponding to the perimeter 22 is defined and then a derivative of that equation is taken at point 24, there is no solution for such a derivative as it is a point of discontinuity. If a derivative is taken of an equation defining perimeter 18 of the preferred sink 10, a solution can be defined for a derivative of such an equation for all points along the perimeter 18. This is believed to be an important feature of at least one embodiment of the present invention.

While some above counter prior art sinks may have a continuous perimeter, it is not believed to occur at an upper elevation as the outermost perimeter is usually downwardly directed from an uppermost elevation in those designs (i.e., from an inwardly positioned ridge).

Figure 2:
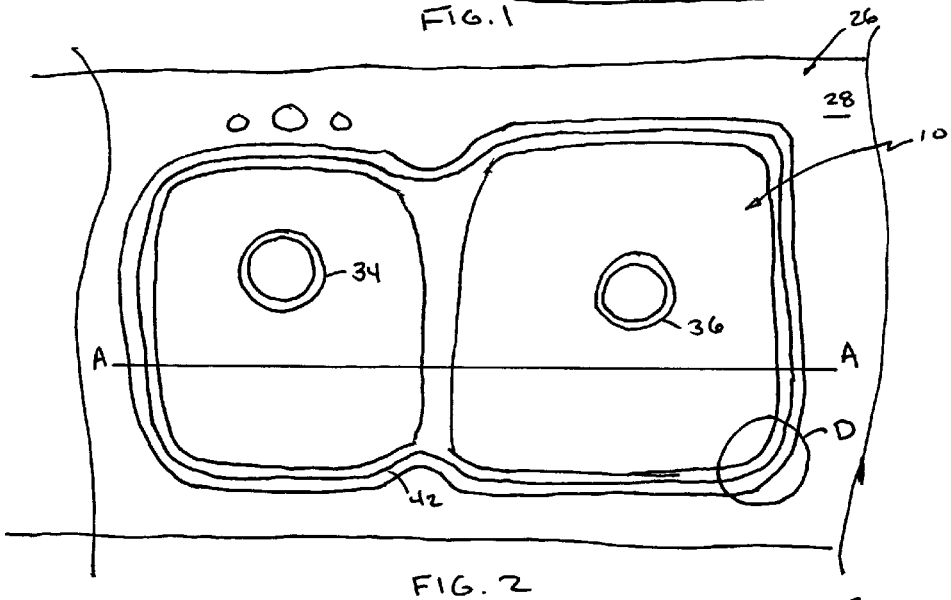
FIG. 2 is a top plan view of the sink of FIG. 1 installed in a countertop in accordance with the presently preferred embodiment of the present invention.
Figure 3:
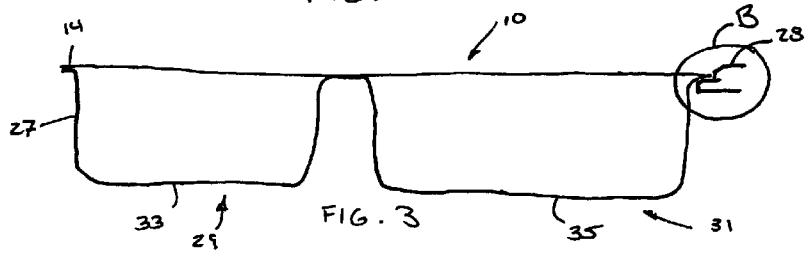
FIG. 3 is a cross-sectional view taken along line A-A of FIG. 2.

FIG. 2 shows a sink 10 installed in a portion of a countertop 26. The countertop 26 has an upper elevated surface 28 which is preferably planar as illustrated. FIG. 3 shows how sink 10 is recessed relative to the upper surface 28 of the countertop 26 when installed. Details of this construction can be better seen in the various embodiments of FIGS. 4, 5 and 7 discussed in further detail below. FIG. 3 is useful to see the side walls 27 which assist in defining at least one sink bowl 29 and 31, especially in conjunction with bottoms 33,35. Although two bowls are shown, more or less could be provided in other embodiments.

Figure 4:
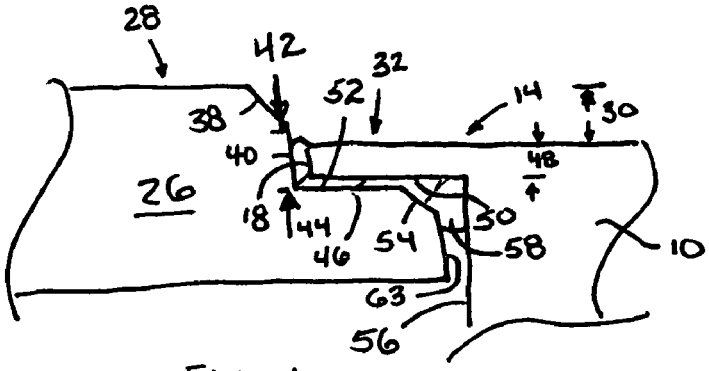
FIG. 4 is a detailed view of the portion B in FIG. 3.

FIG. 4 shows upper surface 28 of countertop 26 extending out, or more preferably, an elevation 30 above upper surface 32 of lip 14 of sink 10.

The upper surface 28 of countertop 26 is extending a distance above the upper surface 32 of lip 14 so that if water or other materials were pushed off of the upper surface 28 of the countertop 26, it would then be downwardly directed on top of the lip 14 if not into sink 10 such as to go down one of the two drains 34,36. Of course, in other embodiments, upper surface 28 could be flush with upper surface 32.

From upper surface 28 of countertop 26 a first slope 38 which may preferably be one of a bevel and/or a rounded or curved edge as will be described in further detail below leads towards a ledge 46. The first slope 38 preferably has an elevation drop of up to, but preferably less than, the elevation drop 30 between the upper surface 28 of the countertop 26 and the upper surface 30 of the lip 14. It is possible that in some installations, the upper surface 32 may be coplanar with the upper surface 28 of the countertop 26 but it is preferred that the elevation drop 30 be a predetermined amount such as about ¼ inch. In some embodiments up to ½ inch or more may be preferable.

After dropping elevation of first slope 38, it is possible that the countertop 26 may have a vertically extending wall 40 which defines a first inner perimeter 42 about outer perimeter 18 of the lip 14 of the sink 10. Just like the outer perimeter 18 of the lip 14, the first inner perimeter 42 is preferably continuous with no discontinuities. The perimeter 42 may be formed in or machined or otherwise provided in the countertop 26 and substantially coincides with outer perimeter 18 of lip 14 in the presently preferred embodiments.

The vertical wall 40 preferably may have a wall elevation 44 which is at least about the same thickness of lip 14 where it is received on ledge 46 which is represented by a thickness 48, which is illustrated as being substantially uniform in the illustrated embodiments. In some embodiments, the vertical wall 40 may have a higher elevation than the thickness 48 of the lip 14. The lip 14 is also illustrated as being planar over much of its structure.

The lip 14 preferably has a bottom surface 50 which rests atop an upper surface 52 of the ledge 46 wherein the ledge 46 preferably supports at least a substantial portion of the weight of the sink 10. The first slope 38 has been found to assist in guiding the sink 10 into a desired location on the ledge 46. Also shown in FIG. 4 is a second slope 54 which assists in providing a seal and seat with the sink 10 wherein the lip 14 returns to downwardly extending wall 56 and so that a seal 58, such as a silicone or other material, can be provided to seal and/or secure the sink 10 to the countertop 26 when installed. In this preferred installation manner, the seal 58 extends up to and approximately slightly above the upper surface 32 of the lip 14. Seal 58 also extends intermediate lower surface 50 of lip 14 and ledge 46 and even down intermediate inner wall 63 or second slope 54 and sink wall 56. In alternative embodiments, the first slope 38 may be beveled as shown in FIG. 4 or provided as rounded corner 60 shown in FIG. 5 or as otherwise configured. Second slope 54 can also be a beveled, rounded or other shaped slope 62. Second slope 54 lends to inner wall 63 which defines a second inner perimeter of the counter top 26 which is interiorly disposed relative to the first inner perimeter 42. Variations on these designs could be provided as will be understood by one of ordinary skill in the art.

Lip 14 extends cantileveredly relative to at least one sink wall 27 or 56. Furthermore, lip 14 is disposed at an upper portion of wall 27 or 56 if not at the top of it as illustrated. Lip 14 extends continuously about at least one, if not two or more, bowls 29 and 31 in the illustrated embodiment. The lip 14 extends perpendicularly or substantially perpendicularly to the sink wall 27 or 56.

Figure 6:
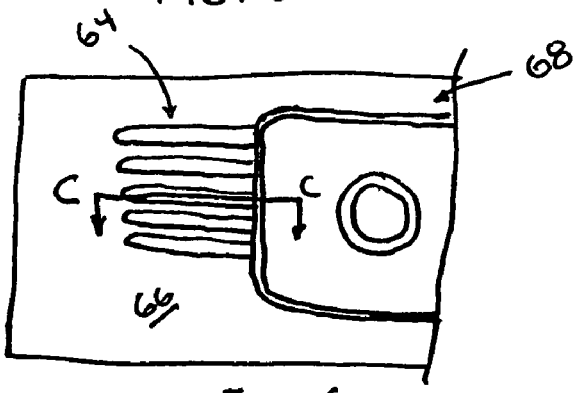
FIG. 6 is an alternative embodiment of that shown in FIG. 2 showing drain slots formed into the countertop.
Figure 7:
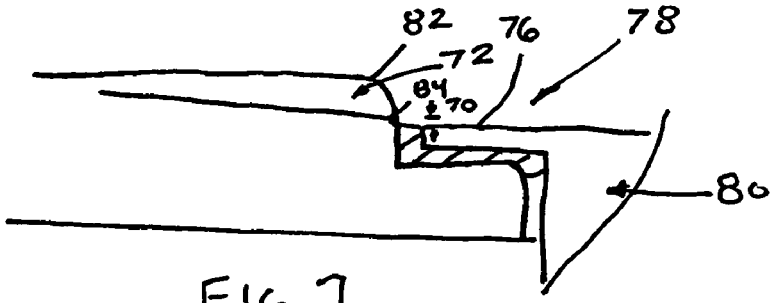
FIG. 7 shows a cross-sectional view taken along the lines C-C of FIG. 6.

FIG. 6 shows an alternatively preferred embodiment of a countertop such as the countertop shown in FIG. 2, namely, in that it has a drain board 64 machined into an upper surface 66 of countertop 68. This can easily be done in solid surface and could possibly be done with equipment into other materials. As is shown in FIG. 7, it is preferred that a bottom elevation 70 of trough 72 extends at or about an elevation 70 above an upper surface 76 of the lip 78 of sink 80. Once again, the slope surface 82 could be rounded and/or beveled or otherwise provided. Additionally, a third slope surface 84 is likely to exist at the exit of the trough 72 as it dumps out towards the sink 80 such as a rounded corner, bevel, etc.

Figure 5:
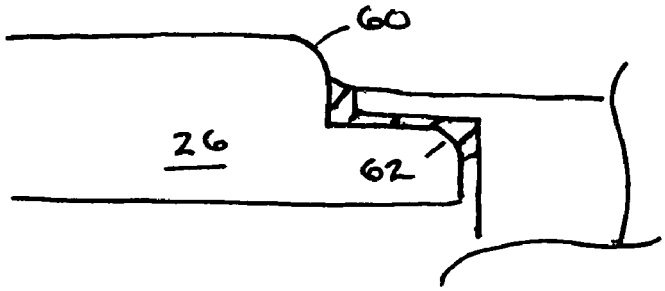
FIG. 5 is an alternative embodiment of the detail shown in FIG. 4.
Figure 8:
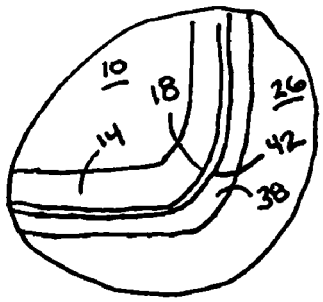
FIG. 8 shows a detailed view of the portion D shown in FIG. 2.

FIG. 8 shows a detail of the portion D in FIG. 2. Specifically, the slope 38 is illustrated extending down towards upper wall which defines inner perimeter 42 where the sink 10 is installed. The lip 14 with its outer perimeter 18 is illustrated in essentially almost contact engagement with the vertical wall 40 but depending on tolerances, may be not precisely in contact at every point, or may be spaced therefrom as illustrated. As can be seen in FIGS. 4, 5 and 7, the seal 58 where the silicone or other material is used keeps water from passing between the vertical wall 40 and the outer perimeter 18 and over the ledge 46 and down below the sink 10 without going into the sink 10.

Referring back to FIG. 4, in the preferred embodiment the upper surface 32 of lip 14 is the uppermost elevation of sink 10. While the presently preferred embodiment may be that interior portions of the sink can extend to a higher elevation in other embodiments, however, as it relates to the lip 14 (i.e., the portion extending past the exterior sink walls 56), the upper elevation 32 is the higher elevation of the lip 14. Furthermore, it is preferable that the lip 14 be planar and both planar upper surface 32 as well as planar lower surface 50 defining a constant thickness 48 as it extends cantileverdly from the sink wall 56 as illustrated.

Figure 10:
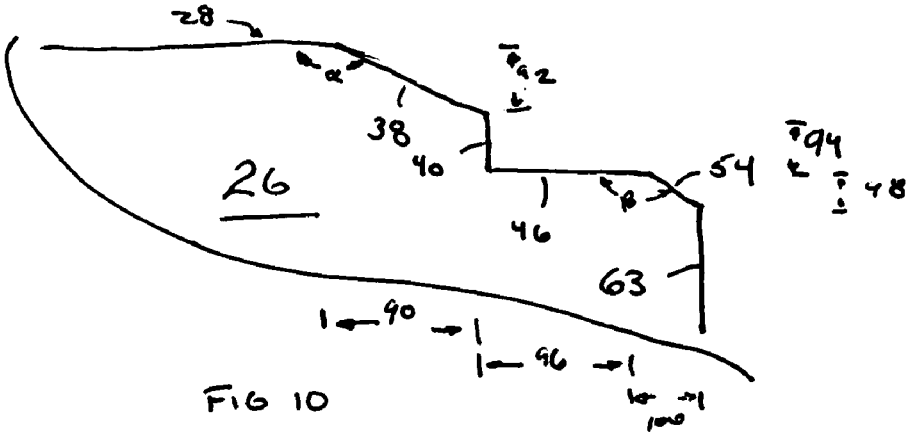
FIG. 10 shows a detailed portion of the countertop shown in FIG. 4.

FIG. 10 is useful to show the cuts which can be made by countertop fabricator such as with a C & C machine or router, etc., into a countertop 26. Beveling and rounding edges and cutting countertop material is known in the art such as for providing beveled and rounded corners at the ends of a countertop that faces into a room. For undermount sinks, a rounded or beveled edge may be provided into some prior art embodiments.

FIG. 10 shows the formation of ledge 46 by machining slope 38 having angle $\alpha$ such as 25°. Alpha ($\alpha$) could be less or more in other embodiments such as little as about 15° or as much as about 45° in other embodiments. A first distance 90 representing the lateral length of slope 38 is shown having a elevation drop 92. In the preferred embodiment, the first distance 90 is about 7.25 mm while the first elevation drop 92 is about 3.38 mm, thus leaving a slope 38 a planar 8 mm. The vertically extending wall 40 has a second elevation 94 of about 3 mm in the preferred embodiment. The length 96 of ledge 46 is illustrated as about 6.43 mm but other lengths could be utilized in other embodiments. Second slope 54 has a length of about 3 mm as illustrated and an elevation drop 98 of about 1.26 mm and a lateral length 100 of about 2.72 mm. The angle Beta (β) may be similarly or dissimilarly angled like the angle alpha (α).

The total elevation drop from the upper surface 28 to the bottom of the second slope 54 is about 7.64 mm and the total length from the start of the first slope 38 to the end of the second slope 54 is 16.3 mm in the preferred embodiment. Other dimensions can be utilized in other embodiments but these dimensions have been found satisfactory for some installations. In such an embodiment, there may be about an inch, or more or less of material underneath the ledge 46 to assist in supporting the sink 10 in at least a partially cantileveredly manner by the lip 14.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A sink and countertop combination comprising:

a sink having at least one bowl defined by side walls and a bottom;

a lip cantileveredly connected to an upper portion of at least some of the side walls with said lip extending continuously as one of a straight edge and curve with no discontinuities about the at least one bowl providing an outer perimeter; and wherein the outer perimeter of the lip provides an uppermost elevation of the lip; and a countertop having an uppermost surface at or above the lip and a cutout providing a ledge onto which the lip is supported, said lip and said ledge having a seal therebetween connecting and sealing the lip to the ledge, said cutout proceeding downwardly from the uppermost surface at a first non-vertical slope, said first non-vertical slope terminating at a first vertical wall, wherein the first vertical wall surrounds the outer perimeter of the lip.

2. The sink of claim 1 wherein the lip is planar.

3. The sink of claim 2 wherein the lip has a substantially uniform thickness, and the cutout has an outermost perimeter at the uppermost surface, and the outermost perimeter of the cutout is larger than and surrounds the outer perimeter of the lip.

4. The sink of claim 2 wherein the lip is at least substantially perpendicular to the side walls of the at least one bowl.

5. The sink of claim 1 wherein the countertop further comprises a first inner perimeter defined below an upper surface of the countertop at the first vertical wall, said first inner perimeter extending outwardly about the outer surface of the lip and is a portion of an exposed wall of the countertop and is defined within the outermost perimeter of the cutout.

6. The sink of claim 5 wherein slope is one of a beveled and curved edge.

7. The sink of claim 5 further comprising a second non-vertical slope intermediate the ledge and an inner wall.

8. The sink of claim 7 wherein the inner wall defines a second inner perimeter with the second inner perimeter located interiorly of the first inner perimeter and the seal is a silicone material.

9. The sink of claim 5 wherein the lip has an upper surface and the upper surface of the lip is located an elevation below the upper surface of the countertop.

10. The sink of claim 1 further comprising at least two bowls and the outer perimeter of the lip extends about the at least two bowls continuously.

11. A sink and countertop construction comprising:

a sink having at least one bowl defined by side walls and a bottom;

a lip cantileveredly connected to an upper portion of at least some of the side walls with said lip having an upper surface and extending about the at least one bowl providing an outer perimeter; and an at least substantially planar countertop having an uppermost surface at a first outer perimeter spaced from a lower ledge at a first inner perimeter defined by a first vertical wall from which the lower ledge extends inwardly therefrom; and wherein the upper surface of the lip is located one of at and below the uppermost surface of the countertop; and a seal is located between the lip and the ledge; and wherein the lip is located inwardly of the first vertical wall which surrounds the lip.

12. The sink and countertop construction of claim 11 wherein the outer perimeter has no discontinuities.

13. The sink and countertop construction of claim 11 wherein the outer perimeter of the lip provides an uppermost elevation of the lip relative to the sink bowl.

14. The sink and countertop construction of claim 11 wherein the upper surface of the countertop is spaced from the first inner perimeter by a first slope.

15. The sink and countertop construction of claim 14 wherein the first slope is one of a beveled and a rounded edge.

16. The sink and countertop construction of claim 14 further comprising a second slope internally disposed relative to the inner perimeter with the second slope descending from the ledge toward a second inner perimeter.

* * * * *